US009518713B2

(12) United States Patent
Lee

(10) Patent No.: US 9,518,713 B2
(45) Date of Patent: Dec. 13, 2016

(54) BI FUNCTION LED HEAD LAMP USING THIN SHIELD

(71) Applicant: HYUNDAI MOBIS CO., LTD, Seoul (KR)

(72) Inventor: Hyun Soo Lee, Yongin-si (KR)

(73) Assignee: HYUNDAI MOBIS CO., LTD, Seoul (KR)

( * ) Notice: Subject to any disclaimer, the term of this patent is extended or adjusted under 35 U.S.C. 154(b) by 91 days.

(21) Appl. No.: 14/695,988

(22) Filed: Apr. 24, 2015

(65) Prior Publication Data

US 2015/0308647 A1 Oct. 29, 2015

(30) Foreign Application Priority Data

Apr. 25, 2014 (KR) ..... 10-2014-0050039

(51) Int. Cl.
*F21V 7/00* (2006.01)
*F21S 8/10* (2006.01)

(52) U.S. Cl.
CPC ..... *F21S 48/1747* (2013.01); *F21S 48/1159* (2013.01); *F21S 48/1216* (2013.01); *F21S 48/1233* (2013.01); *F21S 48/1382* (2013.01); *F21S 48/1388* (2013.01); *F21S 48/145* (2013.01); *F21S 48/1705* (2013.01); *F21S 48/1258* (2013.01); *F21S 48/1323* (2013.01)

(58) Field of Classification Search
CPC F21S 48/1159; F21S 48/1216; F21S 48/1233; F21S 48/1323; F21S 48/1382; F21S 48/1388; F21S 48/145; F21S 48/1752
See application file for complete search history.

(56) References Cited

U.S. PATENT DOCUMENTS 5,307,247 A 4/1994 Cejnek
2005/0068787 A1* 3/2005 Ishida ..... B60Q 1/14 362/538
2009/0021942 A1* 1/2009 Kim ..... F21S 48/1258 362/268

(Continued)

FOREIGN PATENT DOCUMENTS

DE 100 04 699 A1 8/2001
DE 10 2012 102441 A1 9/2013

(Continued)

OTHER PUBLICATIONS

European Extended Search Report (EESR) dated Aug. 31, 2015 of corresponding European Patent Application No. 15163883.0—7 pages.

(Continued)

*Primary Examiner* — Ali Alavi
(74) *Attorney, Agent, or Firm* — Knobbe Martens Olson & Bear LLP

(57) ABSTRACT

Disclosed is a bi function LED head lamp using a thin shield. The lamp includes: a low beam light source and a high beam light source installed at inner upper and lower sides of a reflector; a shield installed at a front end of the partition in the reflector; a lens holder in which the rear is joined to a front surface of the reflector; and a signal reflection surface installed at an inner lower end of the lens holder. The low beam and the high beam are implemented only by turning on and off an LED through applying the thin shield without an actuator.

7 Claims, 1 Drawing Sheet

(56) References Cited

U.S. PATENT DOCUMENTS

| | | | | |
|---|---|---|---|---|
| 2011/0205748 | A1 | 8/2011 | Yatsuda | |
| 2014/0301102 | A1* | 10/2014 | Han | F21S 48/1154 362/520 |
| 2015/0276160 | A1* | 10/2015 | Lee | F21S 48/125 362/516 |

FOREIGN PATENT DOCUMENTS

| | | | |
|---|---|---|---|
| EP | 2 182 272 | A1 | 5/2010 |
| FR | 2 860 280 | A1 | 4/2005 |
| JP | 2005-108554 | A | 4/2005 |
| JP | 2008-004456 | A | 1/2008 |
| JP | 2015-037037 | A | 2/2015 |
| KR | 10-0860609 | B1 | 9/2008 |
| KR | 10-2010-0114804 | A | 10/2010 |
| KR | 10-2014-0036528 | A | 3/2014 |
| KR | 10-2014-0039884 | A | 4/2014 |

OTHER PUBLICATIONS

Japanese Office Action dated Apr. 5, 2016 of corresponding Japanese Patent Application No. 2015-077674—3 pages.

* cited by examiner

BI FUNCTION LED HEAD LAMP USING THIN SHIELD

CROSS-REFERENCE TO RELATED APPLICATIONS

This application claims priority to and the benefit of Korean Patent Application No. 10-2014-0050039 filed in the Korean Intellectual Property Office on Apr. 25, 2014, the entire contents of which are incorporated herein by reference.

TECHNICAL FIELD

The present disclosure relates to a bi function LED head lamp.

BACKGROUND ART

In general, in a head lamp for a vehicle, an actuator of a bi-function module has a disadvantage in generation of noise, increase of cost, and increase of a weight. Further, when an LED bi-function is applied, the head lamp for the vehicle can be actuated without the actuator, but a signal reflection surface is impossible to be positioned by applying a shield fixed to the existing position, and as a result, it is difficult to satisfy a signal regulation.

As one example of a vehicular head lamp technique, Korean Patent Unexamined Publication No. 10-2014-0039884 discloses "Head Lamp for Vehicle Which Prevents Vibration Phenomenon of Beam Pattern in Switching High Beam to Low Beam by Using Moving Shield".

Korean Patent Unexamined Publication No. 10-2014-0036528 discloses "Head Lamp for Vehicle Regarding Rotational Structure of Head Lamp Used in Leveling".

Korean Patent Unexamined Publication No. 10-2010-0114804 discloses "Driving Device of Head Lamp Performing Downward Mode Function to Throw Ray Downward and Upward Mode Function to Throw Ray Upward with One Lamp".

Korean Patent Registration No. 860609 discloses "Projection Type Head Lamp Assembly for Vehicle Which Provides Various Beam Patterns According to Driving Environment of Vehicle".

SUMMARY

One aspect of the present invention provides a bi function LED head lamp using a thin shield that can implement a low beam and a high beam only by turning on and off an LED by applying the thin shield without an actuator.

An embodiment of the present invention provides a bi function LED head lamp using a thin shield including a reflector in which a front inlet is opened and an inner space is partitioned into an upper low beam reflector space and a lower high beam reflector space by a partition installed at the center; a low beam light source installed at a top inner side of the partition so as to be positioned in the upper low beam reflector space; a high beam light source installed at a bottom inner side of the partition so as to be positioned in the lower high beam reflector space; a shield installed at a front end of the partition; a lens holder in which a lens is mounted on the front and the rearis joined to a front surface of the reflector; and a signal reflection surface installed at a lower inner end of the lens holder.

The low beam light source and the high beam light source may be LED light sources.

The shield may be the thin shield and a hole through which the light source passes may be bored at the front end of the shield.

The hole may have a semicircular shape.

The signal reflection surface may be formed integrally with the lens holder.

An upper front surface of the signal reflection surface may face the lens and may be formed by an inclined surface that is inclined back upward from the side view.

Both surfaces of the upper front surface and an upper rear surface of the signal reflection surface may be formed by inclined surfaces of which the widths decrease upward from the side view.

According to an embodiment of the present invention, in a bi function LED head lamp using a thin shield, a low beam and a high beam can be implemented only by turning on and off an LED by applying a thin shield.

A signal reflection surface is manufactured integrally with a lens holder to reduce the number of parts and the number of assemblies and remove an assembly tolerance in assembly.

An actuator for actuating a moving shield is not required unlike a moving shield in the related art.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
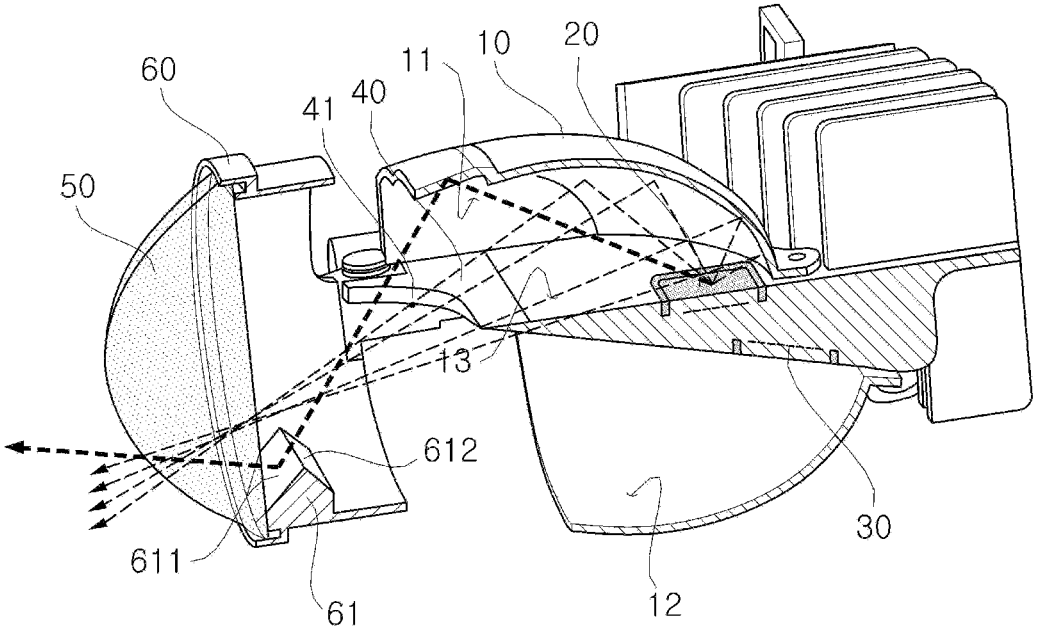
FIG. 1 is a perspective view of a bi function LED head lamp using a thin shield according to an embodiment of the present invention.

It should be understood that the appended drawings are not necessarily to scale, presenting a somewhat simplified representation of various features illustrative of the basic principles or according to embodiments of the invention. The specific design features according to embodiments of the present invention as disclosed herein, including, for example, specific dimensions, orientations, locations, and shapes will be determined in part by the particular intended application and use environment.

In the figures, reference numbers refer to the same or equivalent parts according to embodiments of the present invention throughout the several figures of the drawing.

DETAILED DESCRIPTION

Hereinafter, embodiments of the present invention will be described in detail with reference to the accompanying drawings.

Figure 2:
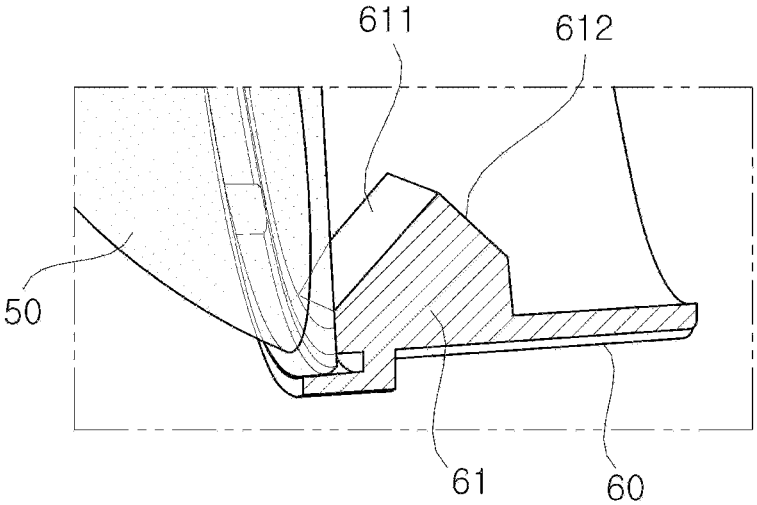
FIG. 2 is an enlarged diagram of a signal reflection surface according to an embodiment of the present invention.

FIG. 1 is a perspective view of a bi function LED head lamp using a thin shield according to an embodiment of the present invention, and FIG. 2 is an enlarged diagram of a signal reflection surface according to an embodiment of the present invention. Hereinafter, a configuration of a bi function LED head lamp using a thin shield according to embodiments of the present invention will be described with reference to the accompanying drawings.

The bi function LED head lamp using the thin shield according to embodiments of the present invention includes a reflector 10 reflecting light irradiated from a light source, a low beam light source 20 and a high beam light source 30 installed at upper and lower sides in the reflector 10, and a lens holder 60 of which a rear side is joined to a front surface of the reflector 10, as illustrated in FIG. 1.

In detail, the reflector 10 serves to reflect the light irradiated from the low beam light source 20 and the high beam light source 30. A front inlet of the reflector 10 joined with the lens holder 60 is opened and the rear side of the reflector 10 is closed. The inside of the reflector 10 is partitioned into an upper low beam reflector space 11 and a lower high beam reflector space 12 by a partition 13 installed at the center therein.

The low beam light source 20 is installed at one top inner end of the partition 13 at the low beam reflector space 11 side. The high beam light source 30 is installed at one bottom inner end of the partition 13 at the high beam reflector space 12 side. The low beam light source 20 and the high beam light source 30 may be light-emitting diode (LED) light sources.

A shield 40 is installed at a front end of the partition 13. The shield 40 serves to vary a pattern of light irradiated to the front of the vehicle by partially limiting a progress direction of light irradiated from the low beam light source 20 and the high beam light source 30.

The shield 40 according to embodiments of the present invention is a thin shield and has a structure designed in such a manner that a high beam is minimally interfered. To this end, a semicircular hole 41 through which the light source may pass is bored at a front end of the shield 40. The light of the low beam light source 20 and the high beam light source 30 may pass through the semicircular hole 41. The thickness of the center of the shield 40 is very thin as approximately 0.1 mm. The low beam is formed by using the shield 40 and further, the shield 40 is very thin, and as a result, the high beam is minimally interfered.

The lens holder 60 serves to link a lens 50 and the reflector 10. The lens 50 is mounted on the front of the lens holder 60 and the rear of the lens holder 60 is joined to the front of the reflector 10. The lens 50 is an aspherical lens.

A signal reflection surface 61 is formed at one inner lower end of the lens holder 60. In embodiments, the signal reflection surface is manufactured integrally with the lens holder 60 in order to reduce the number of assemblies.

In detail, an upper front surface 611 and an upper rear surface 612 of the signal reflection surface 61 are formed by inclined surfaces of which the widths decrease upward from the side view as illustrated in FIG. 2. The upper rear surface 612 of the signal reflection surface 61 is installed to face the reflector 10 and the upper front surface 611 of the signal reflection surface 61 is installed to face the lens 50.

As marked by dotted lines displayed in FIG. 1, the upper front surface 611 of the signal reflection surface 61 needs to be particularly an inclined surface so as for the beam to be irradiated to a signal zone. In embodiments, the upper rear surface 612 need not particularly be the inclined surface, but the upper rear surface 612 is formed by the inclined surface in order to reduce an area.

Hereinafter, an operation of the bi function LED head lamp using the thin shield according to embodiments of the present invention will be described in detail with reference to the accompanying drawings.

As illustrated in FIGS. 1 and 2, the bi function LED head lamp using the thin shield according to embodiments of the present invention may implement a bi-function of the low beam and the high beam only by turning on and off the low beam light source 20 and the high beam light source 30.

In detail, when power is applied to the high beam light source 30, the light of the high beam light source 30 is reflected on an inner wall of a high beam reflector space 12 as illustrated in FIG. 1. The light reflected on the inner wall of the high beam reflector space 12 sequentially passes through the semicircular hole 41 of the shield 40 and the lens 50 to form the high beam.

On the contrary, when the power is applied to the low beam light source 20, the light of the low beam light source 20 is reflected on an inner wall of a low beam reflector space 11. The light reflected on the inner wall of the low beam reflector space 11 sequentially passes through the semicircular hole 41 of the shield 40 and the lens 50 to form the low beam.

In this case, since some light of the low beam light source 20 reflected on the inner wall of the low beam reflector space 11 is reflected to the signal zone by the upper front surface 611 of the signal reflection surface 61, horizontal −8 to 8° and vertical 2 to 4° which are signal regulation areas may be satisfied.

In the bi function LED head lamp using the thin shield according to an embodiment of the present invention, the low beam and the high beam may be implemented only by turning on and off an LED by applying the thin shield. Further, the signal reflection surface is manufactured integrally with the lens holder to reduce the number of parts and the number of assemblies and remove an assembly tolerance during assembly. An actuator for actuating a moving shield is not required unlike a moving shield in the related art.

As described above, the embodiments have been described and illustrated in the drawings and the specification. The embodiments were chosen and described in order to explain certain principles of the invention and their practical application, to thereby enable others skilled in the art to make and utilize various embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A bi function LED head lamp using a thin shield, comprising:

a reflector in which a front inlet is opened and an inner space is partitioned into an upper low beam reflector space and a lower high beam reflector space by a partition installed at the center;

a low beam light source installed at a top inner side of the partition so as to be positioned in the upper low beam reflector space;

a high beam light source installed at a bottom inner side of the partition so as to be positioned in the lower high beam reflector space;

a shield installed at a front end of the partition;

a lens holder in which a lens is mounted on the front and the rear side is joined to a front surface of the reflector; and a signal reflection surface installed at a lower inner end of the lens holder.

2. The lamp of claim 1, wherein the low beam light source and the high beam light source are LED light sources.

3. The lamp of claim 1, wherein the shield is the thin shield and a hole through which the light source passes is bored at the front end of the shield.

4. The lamp of claim 3, wherein the hole has a semicircular shape.

5. The lamp of claim 1, wherein the signal reflection surface is formed integrally with the lens holder.

6. The lamp of claim 5, wherein an upper front surface of the signal reflection surface faces the lens and is formed by an inclined surface that is inclined back upward from the side view.

7. The lamp of claim 5, wherein both surfaces of the upper front surface and an upper rear surface of the signal reflection surface are formed by inclined surfaces of which the widths decrease upward from the side view.

* * * * *